United States Patent [19]

Ukawa

[11] Patent Number: 4,756,934

[45] Date of Patent: Jul. 12, 1988

[54] METHOD AND APPARATUS FOR APPLYING WATER AND OIL REPELLENTS TO ASSEMBLED GARMENTS

[76] Inventor: Koichi Ukawa, 26-13 Kugahara-6 Ohta-ku, Tokyo 146, Japan

[21] Appl. No.: 90,770

[22] Filed: Aug. 27, 1987

[30] Foreign Application Priority Data

Sep. 19, 1986 [JP] Japan ..... 61-219269

[51] Int. Cl.[4] ..... B05D 1/02

[52] U.S. Cl. ..... 427/394; 118/320; 118/321; 118/323; 118/679; 118/696; 68/205 R; 427/425

[58] Field of Search ..... 68/205 R; 118/320, 321, 118/323, 679, 696; 427/425, 394

[56] References Cited

U.S. PATENT DOCUMENTS 2,990,087 6/1961 Brewin et al. ..... 68/205 R 3,865,525 2/1975 Dunn ..... 118/321 X

FOREIGN PATENT DOCUMENTS 1211734 11/1970 United Kingdom ..... 68/205 R

*Primary Examiner*—Shrive P. Beck

*Attorney, Agent, or Firm*—Allston L. Jones

[57] ABSTRACT

Included within an enclosure is a hanger for supporting and rotating a garment in the vicinity of spray and heater means. The spray means is provided to direct a chemical toward the garment with the heater means applying heat to the sprayed garment to cure the applied chemical thereon. Motivation means is also provided to move the spray and heater means to maintain a selected distance between them and the surface of the garment during processing. All of the functions occur in response to signals from a control unit to control, apply and cure the chemical to and on the surface of the garment.

18 Claims, 5 Drawing Sheets

METHOD AND APPARATUS FOR APPLYING WATER AND OIL REPELLENTS TO ASSEMBLED GARMENTS

BACKGROUND OF THE INVENTION

The present invention relates to the application of water and oil repellent compounds to assembled garments, in particular, the spraying and curing of a liquid repellent on the surface of the fabric of assembled garments.

Liquid fluorine compounds when applied to fabrics from which clothing is manufactured are known to provide the treated fabric with the ability to shed water and oils after the treated fabric is properly cured. Curing is typically performed at a temperature in the range of 120–180 degrees C.

The treatment of uncut fabrics is relatively straight forward and can easily be accomplished by an automatic process. However, treating the fabric after the garment is assembled is not so easily accomplished.

It would be desirable to have an apparatus and method whereby the repellent compound could be sprayed and cured on assembled garments automatically, taking the shape and length of the garment into consideration as the process is performed. The present invention accomplishes each of those results automatically.

SUMMARY OF THE INVENTION

In accordance with the illustrated embodiments, the present invention provides a method and apparatus for applying a water/oil repellency chemical to an assembled garment. The invention includes a hanger unit for supporting the garment and rotating the hanger in the vicinity of spray and heater means. The spray means is provided to direct the chemical toward the garment with the heater means provided to apply heat to the sprayed garment to cure the applied chemical thereon. In addition, motivation means is provided to move the spray and heater means to maintain a selected distance between them and the surface of the garment during processing thereof. The invention further includes a control unit to control the rotation of the hanger, movement of the spray and heater means, and the energization of the spray and heater means to substantially, uniformly, apply and cure the chemical to and on the surface of the garment.

DESCRIPTION OF THE PREFERRED EMBODIMENTS

For ease of understanding of the present invention and its several embodiments, the same reference numbers are used in each of the various figures for the same elements of the invention.

Figure 1:
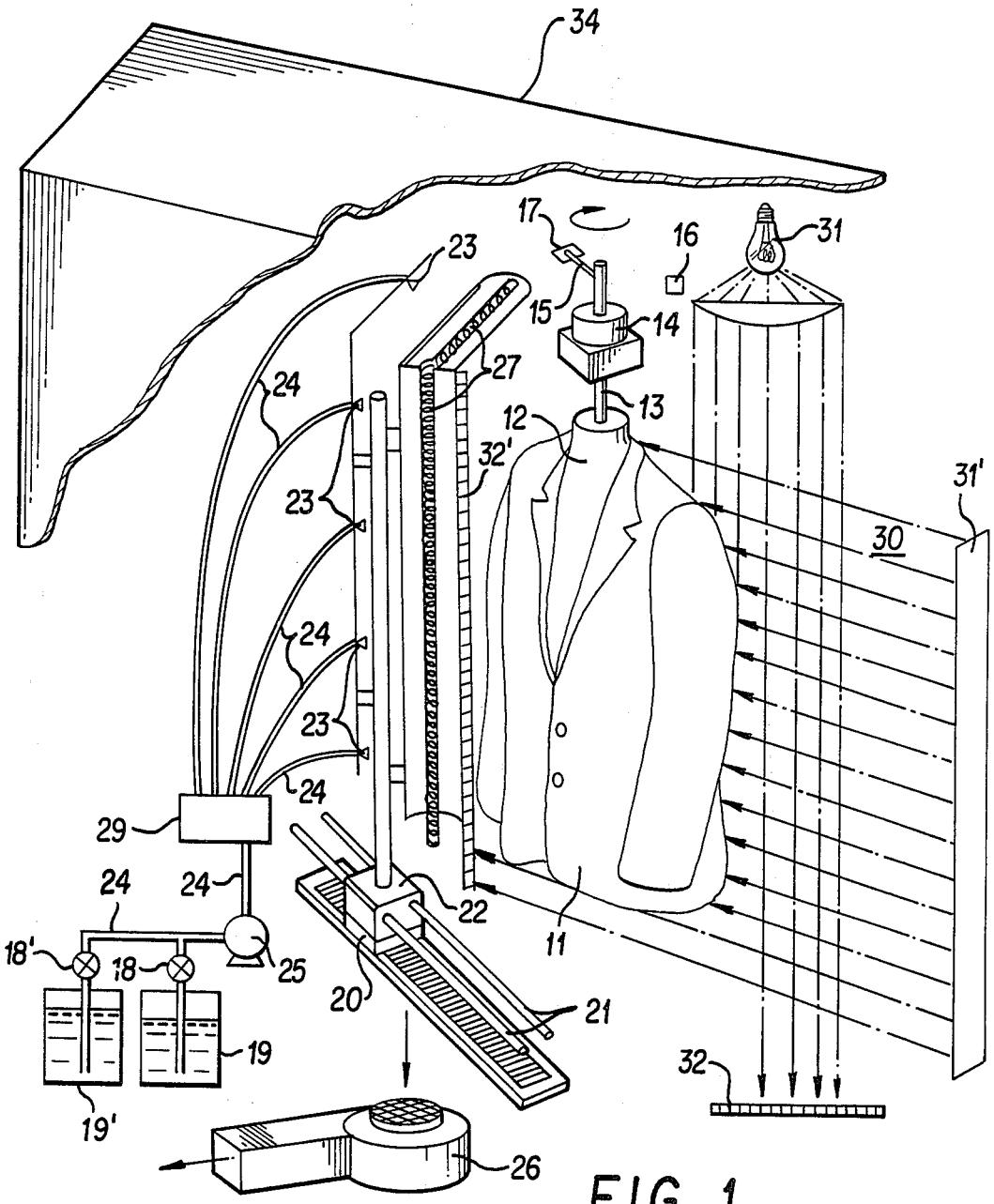
FIG. 1 is a diagrammatic view of the mechanical components of the repellent application apparatus of the present invention.

Referring to FIG. 1 there is shown, diagrammatically, an assembled garment 11 that is to be treated with a water/oil repellent compound. Garment 11 is shown suspended on a hanger unit 12 that is removably affixed to a rotatable shaft 13. Shaft 13 in turn is coupled to a pulse motor 14 by an appropriate speed reducer.

FIG. 1 also shows a heater/spray nozzle system and a garment shape measurement system 30. The heater/spray nozzle system includes a linear pulse motor 20 which drives a truck 22 along a pair of rails 21. Mounted on truck 22 is an array of nozzles 23 and an infrared heater 27 extending upward therefrom, both of which are pointed toward garment 11. Also included in the heater/spray nozzle system are tanks 19 and 19' containing the repellent fluids to be sprayed, a pump 25 coupled between tanks 19 and 19' and the array of nozzles 23 by means of hoses 24 via a nozzle control valve 29, and valves 18 and 18'. Additionally, there is shown a blower 26 to produce an air flow around garment 11 and an enclosure 34 of a typical design to house the entire system.

The garment shape measurement system 30 is provided to measure the outer shape, or the maximum distance of the outermost surface of the garment 11 from the central axis of hanger unit 12 in all directions, and, optionally, the length of garment 11 at each point in its rotation. Included in this system are a downward focused light source 31 with the light beam extending outward from shaft 13 above hanger unit 12, and a linear array of opto-electric transducers 32, such as photo-transistors, beneath garment 11 extending outward from a downward projection of the axis of shaft 13. Also included in the garment measurement system (see FIG. 2) is a priority encoder 33 to identify the last shadowed and first unshadowed segment of transducers 32 closest to the downward projected axis of shaft 13 to identify the projection distance of garment 11 from the axis of shaft 13 at each point in its rotation. Similarly, for the optional length measurements, there are included a horizontally focused light array 31' with the light beam directed at the extended axis of shaft 13 from the top of hanger 12 to just above rails 21 toward a second set of opto-electric transducers 32' mounted vertically on the opposite side of garment 11, and a second priority encoder 33' (FIG. 2) to identify the garment length at any point in time.

Figure 2:
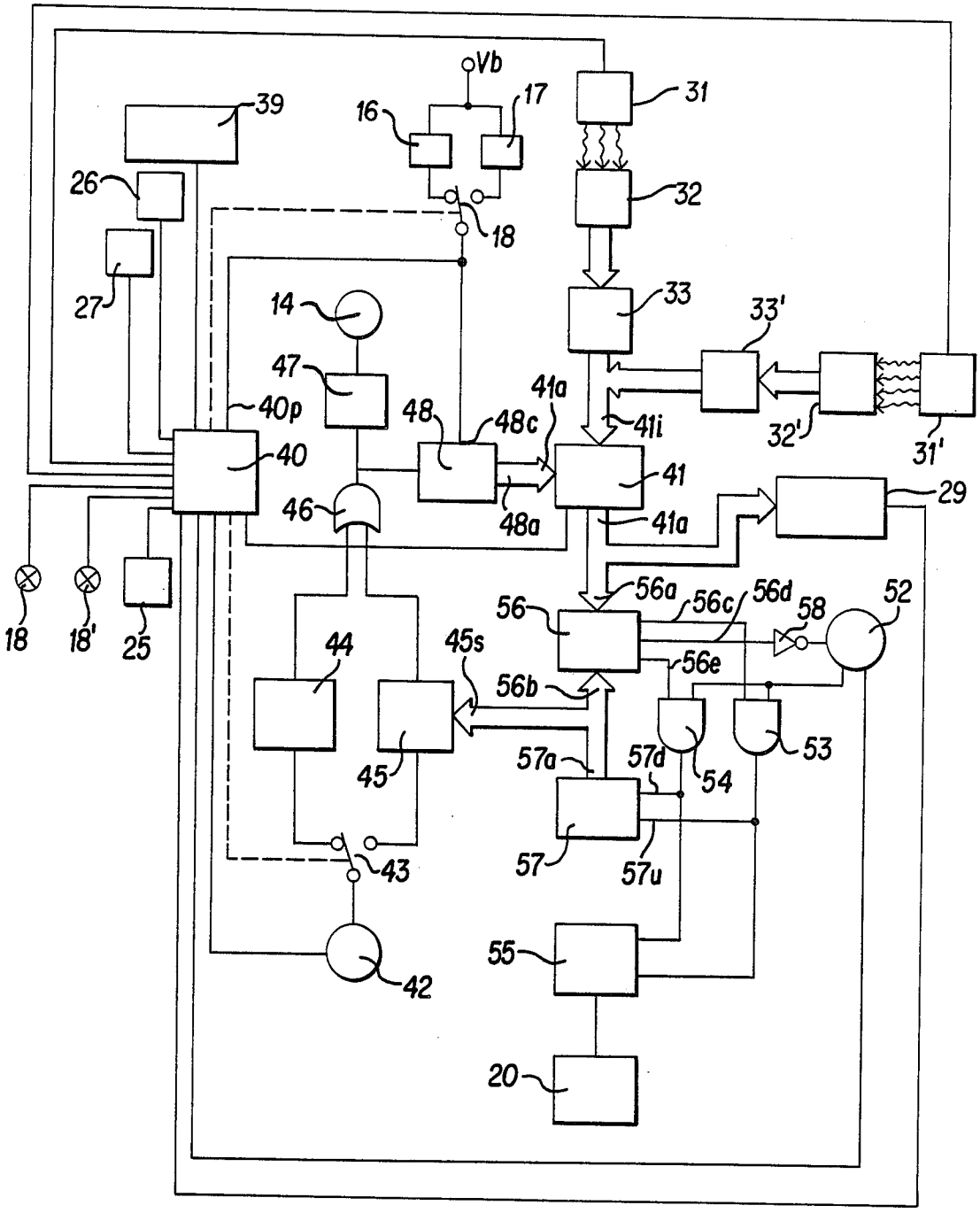
FIG. 2 is an electrical schematic block diagram of the control system for the apparatus of the present invention.

Referring to both FIGS. 1 and 2 there is shown an arm 15 affixed substantially perpendicularly to the shaft of pulse motor 14. The purpose of arm 15 is to actuate normally open, spring loaded, momentarily actuateable, first and second micro switches 16 and 17 as garment 11 is rotated. Micro switches 16 and 17 are connected between a DC voltage source. Vb, and second selector switch 18. Switch 16 is oriented such that arm 15 momentarily actuates switch 16 when the widest portion of hanger unit 12, thus garment 11, is in direct alignment above at least a portion of the array of opto-electric transducers 32. Similarly, when switch 17 is actuated by arm 15, the widest portion of hanger 12, and thus garment 11, is parallel to rails 21.

To automatically perform the series of steps necessary to treat garment 11, a control system as shown in block diagram form in FIG. 2 is provided. The function of this control system, as described more fully below, is to determine the outline of garment 11 as it is rotated and to control the rotation, spraying and curing steps, accordingly. Several of the items already introduced with respect to FIG. 1 are also shown in FIG. 2. These are pulse motor 14 with shaft 13 and arm 15 coupled thereto, first and second micro switches 16 and 17, linear pulse motor 20, opto-electric transducers 32 and 32', priority encoders 33 and 33', valves 18 and 18', pump 25, blower 26, and heater 27, discussed above.

Figure 6:
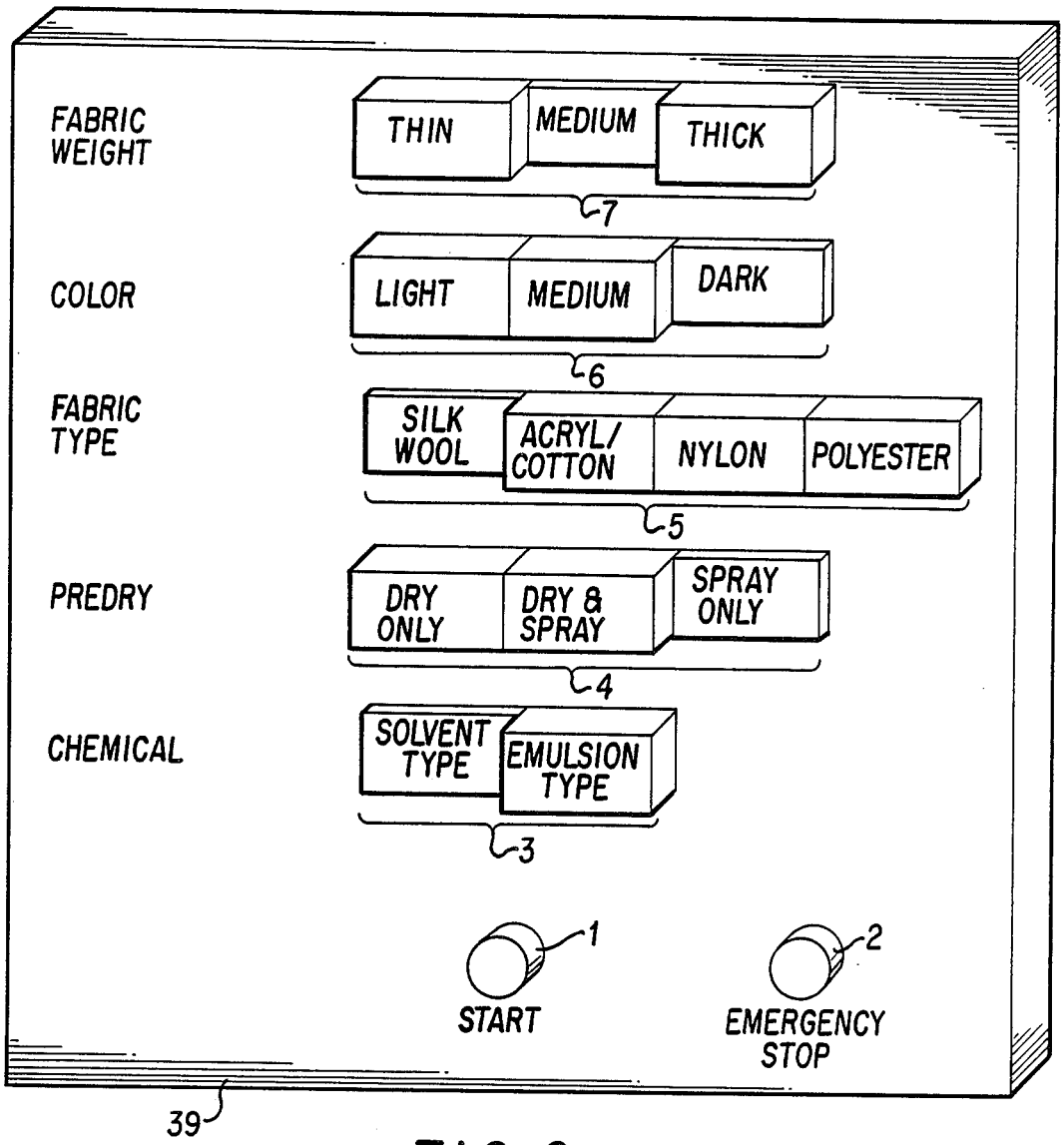
FIG. 6 is a perspective representation of a control panel for the present invention.

The control system further includes a control panel 39 (see FIG. 6) coupled to a sequence controller 40 (e.g. SYSMAC S6 programmable controller from OMRON Tateishi), memory 41, and first and second drive pulse generators 42 and 52, respectively. The function of sequence controller 40 is to control the overall functioning of the control system sequentially in accordance with the treatment program which is described below. Memory 41 is provided to store, for later recall, the outline shape of garment 11 as measured initially by measurement system 30. The first drive pulse generator coordinates the drive of pulse motor 14 with the drive of pulse motor 20 by the second drive pulse generator in response to the outline shape of garment 11 as stored in memory 41.

The first drive pulse generator includes a first pulse generator 42 under the control of controller 40, a first selection switch 43 to direct the output signal from pulse generator 42 to either divider 44 or variable divider 45. Each of the output signals from dividers 44 and 45 are applied to OR gate 46 to direct the output signals from either of the dividers 44 and 45 to driver 47 to drive pulse motor 14.

The second drive pulse generator includes a second pulse generator 52 under the control of controller 40, first and second AND gates 53 and 54, and a driver 55 to drive linear pulse motor 20.

The control system further includes a counter 48 having its input terminal connected to the output terminal of OR gate 46 to count the drive pulses being applied to pulse motor 14. The clear terminal of counter 48 is connected to second selector switch 18 which is provided to select from the output signals of first and second micro switches 16 and 17, and the output port of counter 48 is connected to the address port of memory 41 to provide the memory addresses thereto. In turn, the data entry, or write, port of memory 41 is coupled to the output port of priority encoder 33 to receive, during the write mode, the distance from shaft 13 that garment 11 extends for each position of motor 14, and the garment 11 length information from priority encoder 33', with the total collection of the data in memory 41 defining the outline shape of garment 11 as it hangs on hanger 12.

A comparator 56 is also included with one of its input ports connected to the data out, or read, port of memory 41 to receive the outline shape portion of the data on garment 11, and the other input port connected to the count output port of an up/down counter 57. The greater than and less than compare output terminals 56*c* and 56*e* of the comparator 56 are connected, respectively to one input terminal each of first and second AND gates 53 and 54, respectively, while the coincidence output terminal 56*d* of comparator 56 is connected to the enable input terminal of pulse generator 52 via an inverter 58. The second input terminals of each of first and second AND gates 53 and 54 are connected to the output terminal of pulse generator 52, thus the output signal from first AND gate 53 occurs when a greater than compare condition is detected by comparator 56 with the pulse signal from generator 52 being applied to the UP count input terminal of up/down counter 57 and the forward input terminal of driver 55. Similarly, the output signal from second AND gate 54 occurs when a less than compare condition is detected by comparator 56 with the pulse signal from generator 52 being applied to the DOWN count input terminal of up/down counter 57 and the reverse input terminal of driver 55. The output port of up/down counter 57 is also connected to the divide ratio set port of variable divider 45. The length data from memory 41 is applied to a nozzle control valve 29 to spray the chemical from only those nozzles 23 necessary to cover the full length of garment 11 at any point in its rotation.

PROCESS INITIALIZATION AND GARMENT MEASUREMENT

To start the actual operation of the automatic device of the present invention, switches 3 through 7 on control panel 39 (see FIG. 6) are first depressed to select the characteristics of the fabric of garment 11 that is to be treated and whether there is to be a pre-dry cycle. Switches 3 are used to select the type of chemical to be sprayed on garment 11. In this example, the choice is between a solvent for use on silk and wool, and an emulsion on cotton and synthetic fibers. Switches 3 control valves 18 and 18' to provide the desired chemical to pump 25 from tanks 19 and 19', respectively. Switches 4 are for the selection of a dry only cycle, a dry cycle followed by a spray cycle, or a spray cycle only. The pre-dry switches are provided to enable the present invention to also process wet garments. Switches 5 are for the selection of the fabric type of garment 11. These switches select the routine within controller 40, as described below, to set the proper distance between garment 11 and heater 27 during the drying and curing cycles so as not to over heat garment 11. The rate of heat application acceptable varies for each of the fabric types identified on the four switches 5, with the least amount of heat to be applied to silk and wool (left most switch) to the most heat to be applied to polyester (right most switch) with the amount of heat to be applied increasing for the fabrics identified on switches 5 from left to right. Switches 6 are provided to identify the color of the fabric of garment 11 to control the number of rotations of garment 11 during the drying and curing cycles. More cycles for light colored fabrics than dark colored fabric. This is done to minimize fading during processing. Switches 7 are provided to allow the operator to set the apparatus for the weight of the fabric of garment 11. These switches set the speed of rotation of motor 14 during processing. This controls the quantity of chemical spray applied and the heating time of garment 11, with thick fabrics obtaining the most and thin fabrics the least. The number of rotations, and the exact distance between heaters 27 and garment 11 and nozzles 23 and garment 11 are dependent on the wattage of heaters 27 and the flow rate of the chemicals through nozzles 23 for each type, weight, and color of fabric.

After setting switches 3–7 and placing the garment to be treated on hanger 12, the operator momentarily depresses push-button 1 to apply a start signal to sequence controller 40 with the first step being the measurement of the outline shape of garment 11 and the recording of that information into memory 41. When the process is started the controller 40 initializes the control system by stopping the rotation of shaft 13 when arm 15 closes second micro switch 17, applying power to light sources 31 and 31', applying an enable signal to pulse generator 42 to initiate it, activating switch 18 to connect the first micro switch 16 to counter 48 and controller 40, and activating switch 43 to connect the input terminal of divider 44 to the output terminal of pulse generator 42. Thus, the pulse signal from pulse generator 42 is applied to driver 47, via OR gate 46 and divider 44 to drive pulse motor 14 at a constant speed. In response to the initialization, pulse motor 14 begins to rotate causing shaft 13 and garment 11 to also rotate. When arm 15 actuates the first micro switch 16, a pulse is applied to the clear terminal of counter 48 to reset the count to zero and to the advance terminal of controller 40 to advance the sequence program by one step to place memory 41 in the write mode when the widest portion of garment 11 is between light source 31 and opto electric transducers 32.

As a result of the orientation of garment 11, the projected light from light sources 31 and 31' is partially shielded by the outline shape of garment 11 with a shadow being cast on opto electric tranducers 32 and 32'. In response to the shadow on transducers 32 and 32', priority encoders 33 and 33' determine were the transitions between shadow and direct light closest to the extension of the axis of shaft 13 occurs on transducers 32 and where the length of garment 11 casts a shadow on transducers 33', respectively. The signal from encoder 33 therefore represents the outward extent of garment 11 for that position of motor 14 and that data is applied to data entry port 41*i* of memory 41 at address 0 after converting it to binary code. Similarly, if desired, opto-electric transducers 32' and priority encoder 33' provide the length portion of the data stored at address ||||| in memory 41 for the initial position of garment 11. As motor 14 rotates garment 11, similar information is stored for each position of motor 14 sequentially until garment 11 is rotated through one complete revolution. If the length measurements are not made the system can be simplified accordingly or a full length measurement will be stored for each position of garment 11.

When motor 14 makes one complete revolution, arm 15 again actuates first micro switch 16 generating a second pulse that is applied to the clear terminal of counter 48 and the advance input terminal of controller 40 to advance the sequence program by a second step. At this time power is removed from light source 31, memory 41 is switched to the read mode, and second selection switch 18 is set to second micro switch 17. As motor 14 continues to rotate, arm 15 actuates second micro switch 17 generating a third pulse which advances the sequence program of controller 40 by another step.

DRYING

If either one of the DRY ONLY or DRY & SPRAY switches 4 have been depressed, a drying cycle will take place following the initialization cycle. In this cycle controller 40 sets the first selector switch 43 to variable divider 45, initiates second pulse generator 52, and turns on heater 27. The present invention then proceeds as described below as for the spraying cycle with heater 27 being positioned as nozzles 23 are described as being positioned, without chemicals being sprayed on garment 11, to evenly heat the fabric of garment 11.

SPRAYING

At this time controller 40 sets the first selector switch 43 to variable divider 45, and initiates second pulse generator 52 if switch 4 was set at SPRAY ONLY, and energizes pump 25 to supply the water/oil repellant chemical to be used on garment 11 to nozzles 23 via nozzle control valve 29 and hoses 24 from either tank 19 or 19', and turns off heater 27 if a drying cycle was performed. The third pulse (fourth pulse when a drying cycle has been performed) also resets the count of counter 48 to |||| to start the read out of data from memory 41 at address |||| with the garment 11 outline shape data being supplied to the first input port of comparator 56, and the garment 11 length data being applied to nozzle control valve 29 to selectively apply chemical to the nozzles 23 to spray the full length of garment 11.

At this point in time up/down counter 57 is released from the reset state with a count of |||| from up/down counter 57 being applied to the second input port of comparator 56. If there is a garment 11 on hanger 12, the output count from memory 41 will be other than zero, resulting in a greater than output signal from comparator 56 on terminal 56*c*. The greater than signal enables the first AND gate 53 to direct the pulse train from second pulse generator 52 to be applied to the forward input terminal of driver 55 which energizes the linear pulse motor 20 to move truck 22 away from the extended axis of shaft 13. Simultaneously, the output signal from first AND gate 53 is applied to the UP count input terminal 57*u* of up/down counter 57 to increase the count by the number of pulses applied thereto.

When the count of up/down counter 57 matches the count stored at address |||| of memory 41, the greater than signal on terminal 56*c* of comparator 56 is removed and a match signal is initiated on terminal 56*d*. With the removal of the greater than signal, the first AND gate 53 is disabled and the pulse train from second pulse generator 52 is removed from the up/down counter 57 up count terminal and driver 55 resulting in linear pulse motor 20 coming to a stop.

As pulse motor 14 continues to rotate, the count of counter 48 continues to advance. As the count of counter 48 advances, additional addresses to memory 41 are selected sequentially and the data stored at each address is applied to comparator 56 and nozzle control valve 29. Since garment 11 is initially being rotated from its point of greatest extent from the axis of shaft 13 to its point of least extent from the axis of shaft 13 to its point of least extent from the axis of shaft 13, comparator 56 provides a less than output signal on its terminal 56*c* since the count from up/down counter 57 remains high. The less than signal is applied to second AND gate 54 to enable it so that the pulse train from second pulse generator 52 is applied to the DOWN count terminal 57*d* of up/down counter 57 to start the down count operation, and to the reverse input terminal of driver 55 to cause the linear pulse motor 20 to move truck 22 backward toward the extended axis of shaft 13.

In this manner, truck 22 is moved backward and forward to appropriate positions and nozzles 23 are turned on and off in accordance with the data representing the outer surface shape of garment 11 stored in memory 41 to maintain the desired distance between the garment and spray nozzles 23 and the flow of chemical spray regardless of the shape of garment 11. Thus, the counting operation of the up/down counter 57 relates to the forward and reverse movement of truck 22 under the control of linear pulse motor 20.

The count output of up/down counter 57 is also applied to variable divider 45 at its divide ratio setting port 45*s* to control the velocity of pulse motor 14 so that the chemical being sprayed on garment 11 is applied evenly as described below. Variable divider 45 provides an output pulse train that is proportional to the pulse train from the first pulse generator 42. The divided pulse is applied to both driver 47 and counter 48 to vary the speed of motor 14.

To cause an even spray of the chemical on garment 11, the dividing ratio of variable divider 45 is set to a larger value when the count of the up/down counter 57 is less than the count from memory 41 to reduce the pulse rate applied to motor 14 to rotate garment 11 at a lower speed, and the dividing ratio of variable divider 45 is set to a lower value when the count of the up/-down counter 57 is greater than the count from memory 41 to increase the pulse rate applied to motor 14 to rotate garment 11 at a higher speed. In this way, the relative speed of the surface of garment 11 past spray nozzles 23 is maintained relatively constant to assure uniform spraying of the water/oil repellent chemical over the entire surface of garment 11.

Figure 3:
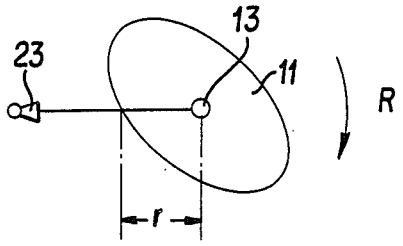
FIG. 3 is a simplified top view of the apparatus of FIG. 1 showing the physical relationship between the rotatable garment and the spray nozzles to demonstrate the relative speed of the surface of the garment as it passes the spray nozzles.

Referring next to FIG. 3 there is shown a simplified diagram of garment 11 suspended from shaft 13 spaced-apart form a single nozzle 23. In this figure R represents the rotational speed of garment 11 and r represents the effective radius of garment 11 in the direction of nozzle 23 at any point in time. From simple physics we know that the surface velocity of garment 11 is proportional to the product of the rotational speed R and the instantaneous radius r, R.||.r. Therefore, if the radius r is increasing or decreasing, the rotational speed R must be decreasing or increasing, respectively, to maintain the surface speed of garment 11 with respect to nozzle 23 to assure uniform spraying of the chemical over the entire surface of garment 11.

The spray operation can be performed over one or more revolutions of garment 11 as desired in response to the operator selections on control panel 39 and the sequences prestored in controller 40 for each of those selections. If multiple revolutions are selected, each time arm 15 actuates second micro switch 17, the count value of counter 48 is reset to zero to properly position garment 11 throughout the next revolution of garment 11, the number of revolutions would be preset by controller 40 with the number of pulses from switch 17 being counted by controller 40 before the program sequence is advanced by another step to discontinue the spraying cycle by stopping pump 25.

CURING

When the sequence program proceeds further, heater 27 and blower 26 have power applied thereto to initiate the curing operation. The curing operation is perform in the same manner as the spraying operation by maintaining a selected distance between garment 11 and heater 27 in response to the outline shape of garment 11 as stored in memory 41. As in the spraying operation, the rotational speed of garment 11 is controlled to maintain a substantially constant surface speed of garment 11 as it passes heater 27 to maintain even heating of garment 11 throughout this operation as in the spraying operation.

For the curing operation, motor 14 is rotated a preselected number of times to fully cure the chemical sprayed onto garment 11. That number of revolutions having been prestored in controller 40, controller 40 again counts the number of closures of switch 17 before finalizing the entire treatment process. When the final pulse from switch 17 is counted, the sequence program of controller 40 is advanced to the final step at which time heater 27 is deactivated and truck 22 is moved to its maximum extent from the extension of the axis of shaft 13. Motor 14 continues to rotate through a number of rotations preset in controller 40 until a final pulse from switch 17 is generated in response to which pulse motor 14 and blower 26 are de-energized to end the operation so that garment 11 can be removed from hanger unit 12.

Figure 4:
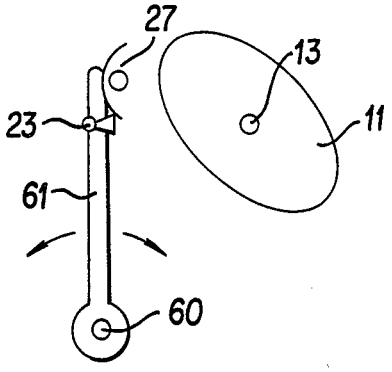
FIG. 4 is a simplified top plan view of an embodiment that employs a radially moveable arm on which the heater and spray nozzles are mounted.

In the first embodiment described above, spray nozzles 23 and heater 27 are both driven by a linear pulse motor 20 on a truck 22. In the second embodiment shown in FIG. 4 spray nozzles 23 and heater 27 are mounted on an arm 61 to be moved toward and away from garment 11 radially by a pulse motor, on the shaft 60 of which, arm 61 is mounted. In the same way as motor 20 was controlled by the circuit of FIG. 2, the pulse motor here is so controlled.

Figure 5A:
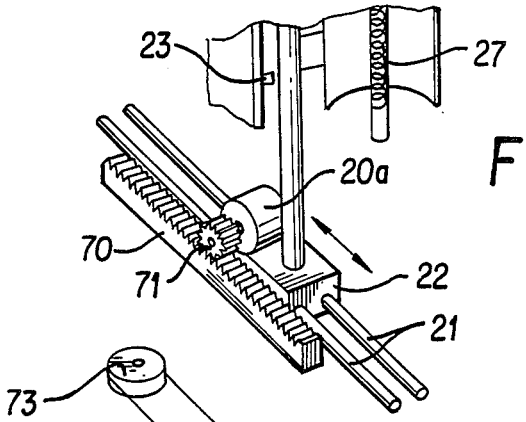
FIGS. 5*a, b,* and *c* each show an embodiment wherein a rotary pulse motor is used to move the heater and spray nozzles during the process of the present invention.
Figure 5B:
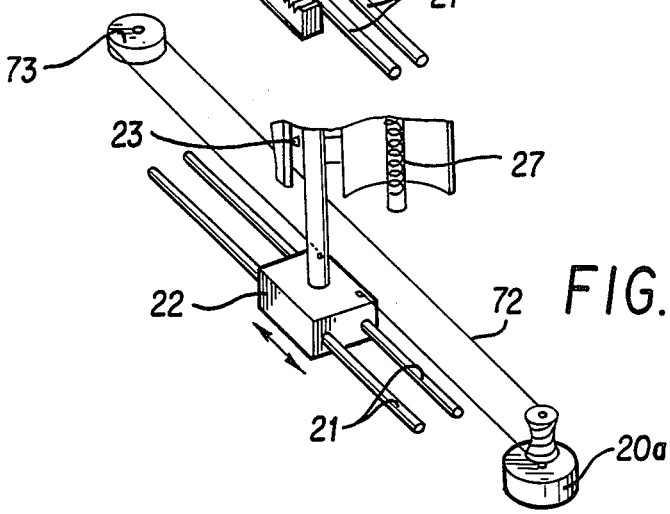
Figure 5C:
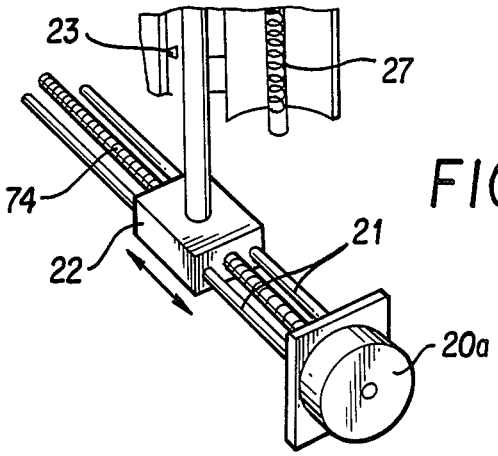

FIGS. 5*a*, *b* and *c* show three additional embodiments that can be utilized for transporting truck 22 linearly along rails 21. In FIG. 5*a* the linear pulse motor of FIG. 1 is shown having been replaced by a rotary pulse motor 20*a* mounted on truck 22 and having a pinion gear on its shaft for meshing with fixed rack 70 to advance and retract truck 22 along rails 21 under the control of the circuit of FIG. 2. Similarly, in FIG. 5*b* a rotary pulse motor 20*a*, having a first pulley on the shaft thereof, drives a wire 72 around a second pulley 73 with both ends of wire 72 connected to opposite sides of truck 22 to pull truck 22 in either direction along rails 21 using the control circuit of FIG. 2. Finally, in FIG. 5*c* there is shown a rotary pulse motor 20*a* driving a ball screw 74 which is threaded through truck 22 to move truck 22 along rails 21 in either direction, again, under the control of the same circuit as the other embodiments, i.e. that of FIG. 2.

While the invention has been illustrated and described in several preferred embodiments, it should be understood that the invention is not limited to the precise details illustrated herein and described above since the same may be carried out in other ways falling within the scope of the invention as illustrated and described. The scope of the present invention is limited only by the scope of the following claims.

What is claimed is:

1. An apparatus for applying a water/oil repellency chemical to an assembled garment comprising:

hanger means for supporting said garment;

spray means for directing said chemical to said garment;

heater means for applying heat to said garment;

first motorized means for rotating said hanger means;

second motorized means having said spray and heater means mounted thereon in part for moving said spray and heater means to maintain a selected distance between said spray and heater means and the surface of said garment; and control unit means for controlling said spray, heater, and first and second motorized means to substantially uniformly apply and cure said chemical to and on the surface of said garment.

2. An apparatus as in claim 1 wherein said control unit maintains the spacing between the surface of said garment and the spray and heater means substantially constant as said hanger means is rotated by said first motorized means.

3. An apparatus as in claim 1 wherein said control unit maintains the relative speed of the surface of said garment at a substantially constant speed with respect to said spray and heater means.

4. An apparatus as in claim 1 wherein said hanger means is interchangeable with other hanger means of various shapes to support different types of garments.

5. An apparatus as in claim 1 wherein:

said first motorized means includes a rotary pulse motor having a shaft to which said hanger means is removeably mounted; and said second motorized means includes:

a truck upon which said spray and heater means are mounted in part; and a linear pulse motor for selectively moving said truck in response to signals from the control unit means toward and away from the extended axis of the shaft of the rotary pulse motor of said first motorized means.

6. An apparatus as in claim 1 wherein the rotational speed of the garment, the distance between the garment and the spray and heater means, and the number of rotations of the garment are selectable for different fabric types, weights and colors of said garment.

7. An apparatus as in claim 1 wherein said heater means includes an infrared heater.

8. An apparatus as in claim 1 wherein:

said control unit means includes:

first measurement means for measuring the length of the garment at each point in its rotation; and memory means for storing the length of the garment at each point in its rotation; and said spray means includes:

a plurality of spray nozzles; and nozzle control valve means for individually selecting said nozzles to spray said garment in response to the length of said garment stored in the memory means of said control unit means.

9. An apparatus as in claim 1 wherein;

said control unit means includes:

first measurement means for measuring the length of the garment at each point in its rotation; and memory means of storing the length of the garment at each point in its rotation; and said heater means includes a plurality of heater segments each individually energizable in response to the length of said garment stored in the memory means of the control unit means.

10. An apparatus as in claim 1 wherein said spray means is adjustable to selectively vary the spray rate of said chemical onto said garment for different fabric weights and types.

11. An apparatus as in claim 1 wherein said spray means includes chemical selection valve means for selecting different chemicals for different fabric types of the garment.

12. An apparatus as in claim 1 wherein said control unit means includes garment outline shape measurements means having:

a light source means for vertically projecting rays of light from above the garment;

light transducer means extending from beneath the garment in alignment with said light source means for receiving unobstructed light rays and the garment shadow thereon; and encoder means for determining whereon said light transducer means the light to shadow transition occurs to measure the outline shape of the garment as it is rotated.

13. An apparatus as in claim 1 further includes housing means for enclosing the apparatus to contain the chemical spray and the heat applied to the garment.

14. A method for applying a water/oil repellency chemical to an assembled garment, said method comprising the steps of:

a. supporting the garment on a rotatable hanger unit;

b. rotating said hanger unit so that the surface of the garment moves at a substantially constant speed with respect to an axis parallel to the axis around which the hanger unit is rotated;

c. moving a plurality of spray nozzles and a heater as the hanger unit is rotated to maintain a substantially constant selected distance between the garment and the spray nozzles and the heater;

d. spraying said chemical on the surface of the garment as step c. is occuring; and e. applying heat to the garment while step c. is occurring and after step d. is completed.

15. A method as in claim 14 further includes the step of:

f. applying heat to dry the garment prior to performing steps d, and e.

16. A method as in claim 14 further including the step of:

g. measuring and recording the outline shape of the garment prior to performing steps c. hrough e.

17. A method as in claim 15 further including the step of:

h. measuring and recording the outline shape of the garment prior to performing steps e. through f.

18. A method as in claim 14 wherein the number of revolutions of the garment in step b. is selected to optimize the treatment of the garment depending on the fabric type thereof.

* * * * *